US007173571B2

(12) United States Patent
Webb et al.

(10) Patent No.: US 7,173,571 B2
(45) Date of Patent: Feb. 6, 2007

(54) PORTABLE ANTENNA POSITIONER APPARATUS AND METHOD

(75) Inventors: Spencer Webb, Pelham, NH (US); David Martin, Nashua, NH (US)

(73) Assignees: Windmill International, Inc., Nashua, NH (US); AntennaSys, Inc., Pelham, NH (US)

( * ) Notice: Subject to any disclaimer, the term of this patent is extended or adjusted under 35 U.S.C. 154(b) by 0 days.

(21) Appl. No.: 11/115,960

(22) Filed: Apr. 26, 2005

(65) Prior Publication Data

US 2005/0248498 A1 Nov. 10, 2005

Related U.S. Application Data

(60) Provisional application No. 60/521,436, filed on Apr. 26, 2004.

(51) Int. Cl.
*H01Q 3/00* (2006.01)

(52) U.S. Cl. ..... 343/766; 343/880; 343/882

(58) Field of Classification Search ..... 343/880, 343/881, 766, 765, 700 MS, 882, 702; 375/219
See application file for complete search history.

(56) References Cited

U.S. PATENT DOCUMENTS

| | | | | |
|---|---|---|---|---|
| 4,811,026 | A * | 3/1989 | Bissett | 343/766 |
| 5,404,583 | A * | 4/1995 | Lalezari et al. | 455/90.3 |
| 2001/0046258 | A1 * | 11/2001 | Wise et al. | 375/219 |

* cited by examiner

*Primary Examiner*—Hoanganh Le
(74) *Attorney, Agent, or Firm*—Dalina Law Group, P.C.

(57) ABSTRACT

Embodiments of the portable antenna positioner described provide a lightweight, collapsible and rugged antenna positioner for use in receiving low earth orbit, geostationary and geosynchronous satellite transmissions. By collapsing the antenna positioner, it may be readily carried by one person or shipped in a compact container. The antenna positioner may be used in remote locations with simple or automated setup and orientation. In order to operate the apparatus, azimuth is adjusted by rotating an antenna in relation to a positioner base and elevation is adjusted by rotating an elevation motor coupled with the antenna. The apparatus may update ephemeris data via satellite, may comprise a built-in receiver and may couple with a second positioner base comprising cryptographic, router or power functionality. The apparatus may comprise storage devices such as a hard drive or flash disk for storing data to and from at least one satellite.

24 Claims, 11 Drawing Sheets

PORTABLE ANTENNA POSITIONER APPARATUS AND METHOD

This application takes priority from U.S. Provisional Patent Application to Webb et al., entitled "Portable Antenna Positioner Apparatus and Method", Ser. No. 60/521,436 filed Apr. 26, 2004, which is hereby incorporated herein by reference.

This invention was made with Government support under F19628-03-C-0039 awarded by US Air Force, Department of Defense. The Government has certain rights in the invention.

BACKGROUND OF THE INVENTION

1. Field of the Invention

Embodiments of the invention described herein pertain to the field of antenna positioning systems. More particularly, but not by way of limitation, these embodiments enable the positioning of antennas by way of a compact, lightweight, portable, self-aligning antenna positioner that is easily moved by a single user and allows for rapid setup and alignment.

2. Description of the Related Art

An antenna positioner is an apparatus that allows for an antenna to be pointed in a desired direction, such as towards a satellite. Many satellites are placed in geosynchronous orbit at approximately 22,300 miles above the surface of the earth. Other satellites may be placed in low earth orbit and traverse the sky relatively quickly. Generally, pointing may be performed by adjusting the azimuth and elevation or alternatively by rotating the positioner about the X and Y axes. Once oriented in the proper direction, the antenna is then best able to receive a given satellite signal.

Existing antenna positioners are heavy structures that are bulky and require many workers to manually setup and initially orient. These systems fail to satisfactorily achieve the full spectrum of compact storage, ease of transport and rapid setup. For example, currently fielded antenna systems capable of receiving Global Broadcast System transmissions comprise an antenna, support, positioner, battery, cables, receiver and PC. These antenna systems require over a half dozen storage containers that each require 3 to 4 workers to lift. Other antenna systems are mounted on trucks and are generally heavy and not easily shipped. Many antenna systems comprise static mounts that are initially set and are never altered, for example antenna dishes configured to receive television transmissions. Static antenna mounts generally require manual setup.

BRIEF SUMMARY OF THE INVENTION

Embodiments of the invention provide a lightweight, collapsible and rugged antenna positioner for use in receiving low earth orbit and geosynchronous satellite transmissions. By collapsing the antenna positioner, it may be readily carried by hand or shipped in a compact container. For example, embodiments of the invention may be stored in a common carry-on bag for an airplane. The antenna positioner may be used in remote locations with simple or automated setup and orientation. Embodiments of the invention may be produced at low cost for disposable applications. The apparatus can be scaled to any size by altering the size of the various components. The gain requirements for receiving any associated satellite transmission may be altered by utilizing more sophisticated and efficient antennas as the overall size of the system is reduced.

The movement of an antenna coupled with embodiments of the portable antenna positioner allows for low earth orbit, geostationary or geosynchronous location and tracking of a desired satellite. Since the slew rate requirements are small for geosynchronous satellites, the motors used in geosynchronous applications may be small.

One embodiment of the invention may be used, for example, after extending stabilizer legs and an adjustable leg to provide a stable base upon which to operate. With a battery already in the apparatus, pinch paddles are squeezed in order to extend the antenna mounting plate to the full range of one positioning arm arrangement. Next, the second positioning arm is locked via a release knob. A motor release knob is engaged and after a PC is connected to the apparatus, the apparatus is ready to acquire a satellite. The entire setup process can occur in rapid fashion. Another embodiment of the invention may utilize alternate mechanical positioning devices such as an arm that extends upward and allows for azimuth and elevation motors to adjust the antenna positioning. Another embodiment of the invention utilizes a smaller azimuth motor and limited range in order to lower the overall weight of the apparatus.

One or more embodiments utilize an adjustable leg or legs that may be motorized with for example a stepper motor. These embodiments are able to alter the effective azimuth angle of a satellite relative to the apparatus so that the satellite is far enough away from the zenith to prevent "keyholing".

In one embodiment of the invention, positioning of an associated antenna is performed by rotating positioner support frame in relation to a positioner base in order to set the azimuth. Setting the elevation is performed by altering the angle of a first positioning arm attached to an antenna mounting plate wherein the antenna mounting plate is further attached to a second positioning arm. Both positioning arms are attached to the positioner support frame. One or both of the positioning arms may be duplicated on opposite sides of the antenna mounting plate. Since the elements are rotationally coupled to each other, rotation of the first positioning arm alters the angle of the antenna mounting plate in relation to the positioner support frame. The motion of the antenna mounting plate alters the angle of the second positioning arm with relation to the positioner support frame. Hence, altering the positioning arm angles with respect to the positioner support frame alters the angle of the antenna mounting plate with respect to the positioner support frame. The resulting motion positions a vector orthogonal to the antenna mounting plate plane in a desired elevation and with the positioner support frame rotated to a desired azimuth, the desired pointing direction is achieved. Another embodiment of the invention makes use of an arm that comprises azimuth and elevation motors that are asserted in order to point an antenna to a desired pointing direction.

The pointing process is normally accomplished via powered means using the mechanisms described above. Various components are utilized by the apparatus to accomplish automated alignment with a desired satellite. A GPS receiver is used in order to obtain the time and the latitude and longitude of the apparatus. In addition, a tilt meter (inclinometer) or three axis accelerometer and magnetometer are be used to determine magnetic north and obtain the pointing angle of the antenna. By placing a group of sensors in both the electronics housing and antenna housing, differential measurements of tilt or magnetic orientation may be used for calibration purposes and this configuration also provides a measure of redundancy. For example, if the magnetometer in the positioner base fails, the magnetometer coupled with the antenna or in the antenna housing may be utilized. Such failure may be the result of an electronics failure or a magnetic anomaly near the positioner base. A low noise block down converter (LNB) along with a wave guide allows high frequency transmissions to be shifted down in frequency for transmission on a cable. One or more embodiments of the invention comprise a builtin receiver that enables the apparatus to download ephemeris data and program guides for channels. Motors and motor controllers to point the antenna mounting plate in a desired direction are coupled with at least one positioning arm in order to provide this functionality. Military Standard batteries such as BB-2590/M for example may be used to drive the motors. Any other battery of the correct voltage may also be utilized depending on the application. A keypad may be used in order to receive user commands such as Acquire, Stop, Stow and Self-Test. A microcontroller may be programmed to accept the keypad commands and send signals to the azimuth, elevation and optional adjustable leg motor in order to achieve the desired pointing direction based on a satellite orbit calculation based on the time, latitude, longitude, north/south orientation and tilt of the apparatus at a given time and the various orbital constants of a desired satellite. Optionally, a PC may host the satellite orbit program and user interface and may optionally transfer commands and receive data from the apparatus via wired or wireless communications.

By way of example an embodiment may weigh less than 20 pounds, comprise an associated antenna with 39 dBic gain, LHCP polarization, frequency range of 20.2 to 21.2 GHz and fit in an airplane roll-on bag of 14×22×9 inches. Embodiments of the invention may be set up in 10 minutes or less and are autonomous after initial setup. Although this example embodiment has a limited frequency range, any type of antenna may be coupled to the apparatus to receive any of a number of transmissions from at least the following satellite systems.

| User | Frequency | Polarization | Tracking |
|---|---|---|---|
| GBS User | 11 GHz Rx<br>20.2 GHz Rx | LP<br>LHCP | GeoSynch NSK<br>Self Aligning |
| GBS + Milstar | (1) Plus<br>20.2 GHz Rx<br>44 GHz Tx | RHCP<br>RHCP | GeoSynch NSK<br>Self Aligning |
| Weather Only | 1.7 MHz<br>2.2–2.3 MHz | LP<br>RHCP | LEO Tracking<br>91° Retrograde<br>Upto 15°/Sec |
| GBS + Weather | (1) Plus (3) | | |
| Weather or DSP Low Rate Downlink (LRD) | 1.7 MHz<br>2.2–2.3 MHz | LP<br>RHCP | GeoSynch<br>Point and Forget |
| Weather NPOESS High Rate Downlink (HRD) | (5) Plus<br>8 Ghz | <br>RHCP | Polar LEO<br>Tracking for 8 GHz |
| Wideband Gap Filler (WGS) SHF Low | 7.9–8.4 GHz Tx<br>7.25–7.75 GHz Rx | RHCP<br>LHCP | GeoSynch NSK<br>Self-Aligning |
| WGS EHF High | 30 GHz Tx<br>20 GHz Rx | RHCP<br>RHCP | GeoSynch NSK<br>Self-Aligning |

Any other geosynchronous or low earth orbiting satellite may be received by coupling an appropriate antenna to the apparatus. For example, a dish or patch array antenna may be coupled to the antenna mounting plate. An example calculation of the size of dish or patch array to achieve desired gains follows. An ideal one-meter dish, at 20 GHz, has a gain of 46.4 dBi. With 68% efficiency, it would have a gain of 44.7 dBi. A one-half meter diameter dish, therefore, would be 6 dB less, for a gain of 38.7 dBi. Certain patch arrays have efficiencies on the order of 30%, or about 3.6 dB below a dish of similar area. A patch array with a gain of 39 dBi would have an area of 0.474 square meters. A dish with a gain of 39 dBi would have an area of 0.209 square meters, or a diameter of 0.516 meters. For a patch array consisting of four panels, this implies each panel should have an area of 0.119 square meters, or 184 square inches. This is a square with sides of 13.6 inches. A panel that measures 20 in. by 12 in. has an area of 240 square inches (0.155 square meters). For the 4-panel system, the area is 960 square inches or 0.619 square meters; with a calculated gain of 40.2 dBi. Embodiments of the invention are readily combined with these example antennas and any other type of antennas. Optionally a box horn antenna may be coupled with the apparatus that is smaller and more efficient than a patch array antenna, but that is generally heavier and thicker.

Position Sensors used in embodiments of the invention allow for mobile applications. One or more accelerometer and/or gyroscope may be used to measure perturbations to the pointing direction and automatically adjust for associated vehicle movements in order to keep the antenna pointed in a given direction.

Some example components that may be used in embodiments of the invention include the Garmin GPS 15H-W, 010-00240-01, the Microstrain 3DM-G, the Norsat LNB 9000C the EADmotors L1SZA-H11XA080 and AMS motor driver controllers DCB-241. These components are exemplary and non-limiting in that substitute components with acceptable parameters may be substituted in embodiments of the invention.

In addition, one or more embodiments of the invention may comprise mass storage devices including hard drives or flash drives in order to record programs or channels at particular times. The apparatus may also comprise the ability to transmit data, and transmit at preset times. Use of solar chargers or multiple input cables allows for multiple batteries or the switching of batteries to take place. The apparatus may search for satellites in any band and create a map of satellites found in order to determine or improve the calculated pointing direction to a desired satellite. The apparatus may also comprise stackable modules that allow for cryptographic, routing, power supplies or additional batteries to be added to the system. Such modules may comprise a common interface on the top or bottom of them so that one or more module may be stacked one on top of another to provide additional functionality. For lightweight deployments all external stackable modules including the legs may be removed depending on the mission requirements.

DETAILED DESCRIPTION OF THE INVENTION

Embodiments of the invention provide a self contained lightweight, collapsible and rugged antenna positioner for use in receiving and transmitting to low earth orbit, geosynchronous and geostationary satellites. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Any mathematical references made herein are approximations that can in some instances be varied to any degree that enables the invention to accomplish the function for which it is designed. In other instances, specific features, quantities, or measurements well-known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
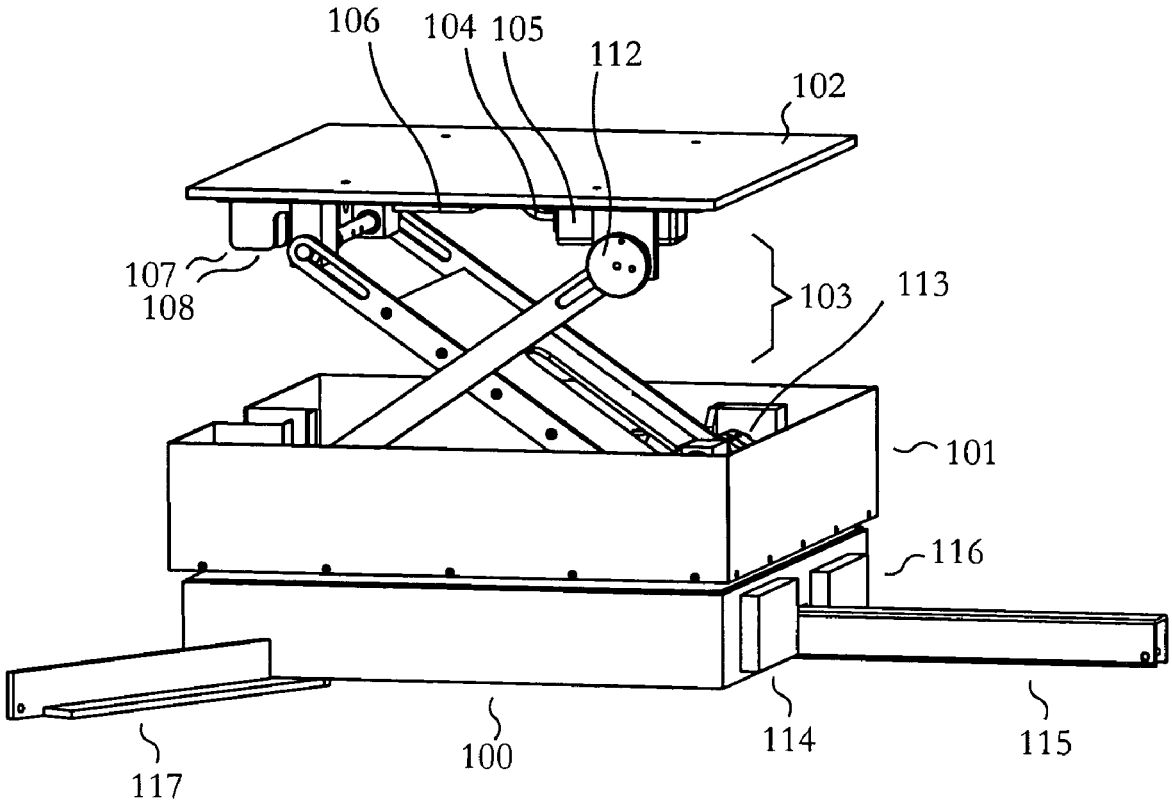
FIG. 1 shows a top perspective view of an embodiment of the invention in the deployed position.

FIG. 1 shows a top perspective view of an embodiment of the invention in the deployed position. Positioner base 100 may be coupled to the ground or any structure that can adequately support the apparatus. An embodiment with stabilizer leg 117 extended as well as adjustable leg 115 extended is shown in FIG. 1. The legs are optional and if an embodiment comprises legs, they are not required for use but may be used individually as required to provide stability based on the exact geography at the deployment site.

Positioner base 100 and positioner support frame 101 may be any geometrical shape although they are roughly shown as rectangular in FIG. 1. Positioner support frame 101 is rotationally mounted on positioner base 100. This rotational mounting allows for altering the azimuth setting of the apparatus. Keypad port 114 and GPS sensor port 116 allow for access to the respective elements housed internal to the positioner base during shipping. Optional or combined use of and control of the apparatus may be accomplished via a PC (not shown).

Figure 2:
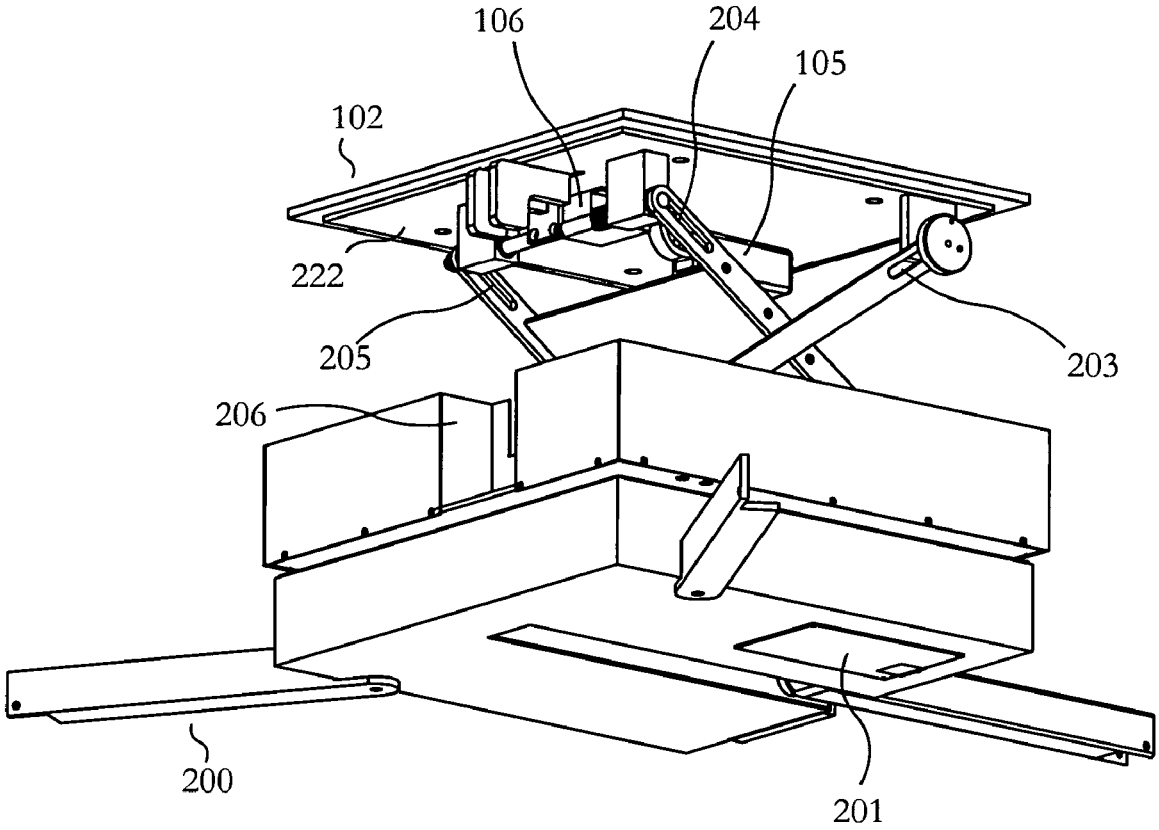
FIG. 2 shows a bottom perspective view of an embodiment of the invention in the deployed position.

Collapsible antenna positioner 103 is further described below and in FIG. 4. The collapsible antenna positioner allows for altering the elevation of antenna 102 mounted on antenna mounting plate 222 (as shown in FIG. 2). Beneath antenna mounting plate 222 lies waveguide 104 and LNB 105. Tilt sensor and magnetometer 106 is also coupled with the bottom of antenna mounting plate 222. Tilt sensor and magnetometer 106 is used in order to measure the angle that antenna mounting plate 222 is pointing and determine the direction of North. Pinch paddles 107 and 108, release knobs 112 and 113 are used in order to disengage the positioning arms from antenna mounting plate 222 and elevation motor as will be explained in relation to FIG. 4. Any method of disengagement may be substituted with regards to pinch paddles 107 and 108 and release knobs 112 and 113.

FIG. 2 shows a bottom perspective view of an embodiment of the invention in the deployed position. Stabilizer leg 200 is visible in this figure. The deployment of stabilizer leg 200 is optional as well as is the deployment of stabilizer leg 117 and adjustable leg 115 as shown in FIG. 1. Optional battery compartment 201 allows for battery removal and replacement without disturbing the internal components of positioner base 100. Pinch paddle port 206 allows for operation of the pinch paddles when the apparatus is in the collapsed position. Collapse grooves 203, 204 and 205 allow for the collapsing of collapsible antenna positioner 103 as shown in FIG. 1 by allowing for the disengaging of the respective axles in the associated positioning arms as will be further described in relation for FIG. 4.

Figure 3:
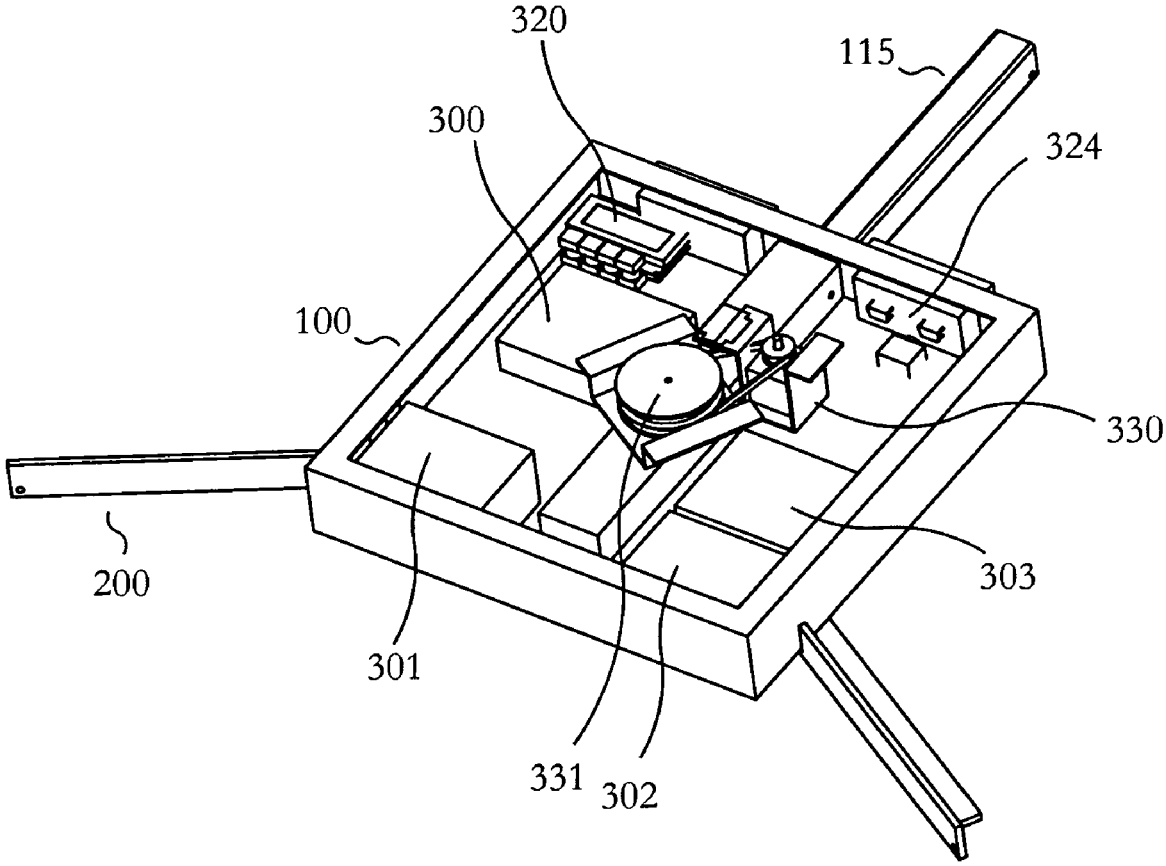
FIG. 3 shows a perspective view of an embodiment of the positioner base with cover removed to expose internal elements.

FIG. 3 shows a perspective view of an embodiment of the positioner base with cover removed to expose internal elements. Normally, positioner base 100 is closed to the external elements so that dust and water are not be able to readily enter the apparatus. Microcontroller 300 hosts the control program which reads inputs from keypad 320 and commands azimuth motor 330 to rotate via motor controller 303 to a desired azimuth based on various inputs. Optional motor controller 302 may run the elevation motor in the positioner support frame, or motor controller 303 may comprise a two port motor controller capable of running both motors independently. GPS receiver 324 provides time and position information to microcontroller 300. Drive hub 331 rotates positioner support frame 101 in order to point antenna 102 mounted to antenna mounting plate 222 in the desired azimuth. Optional location for battery 301 may be as shown in FIG. 3, or as was shown in FIG. 2 may lie between motor controller 303 and GPS receiver 324. Optionally, if motor controller 303 comprises two independent ports, then motor controller 302 may be replaced by an optional wireless transceiver to eliminate the need to physically connect to a PC. Any other unused space within positioner base 100 may also be used for external communications such as wireless transceivers.

Figure 4:
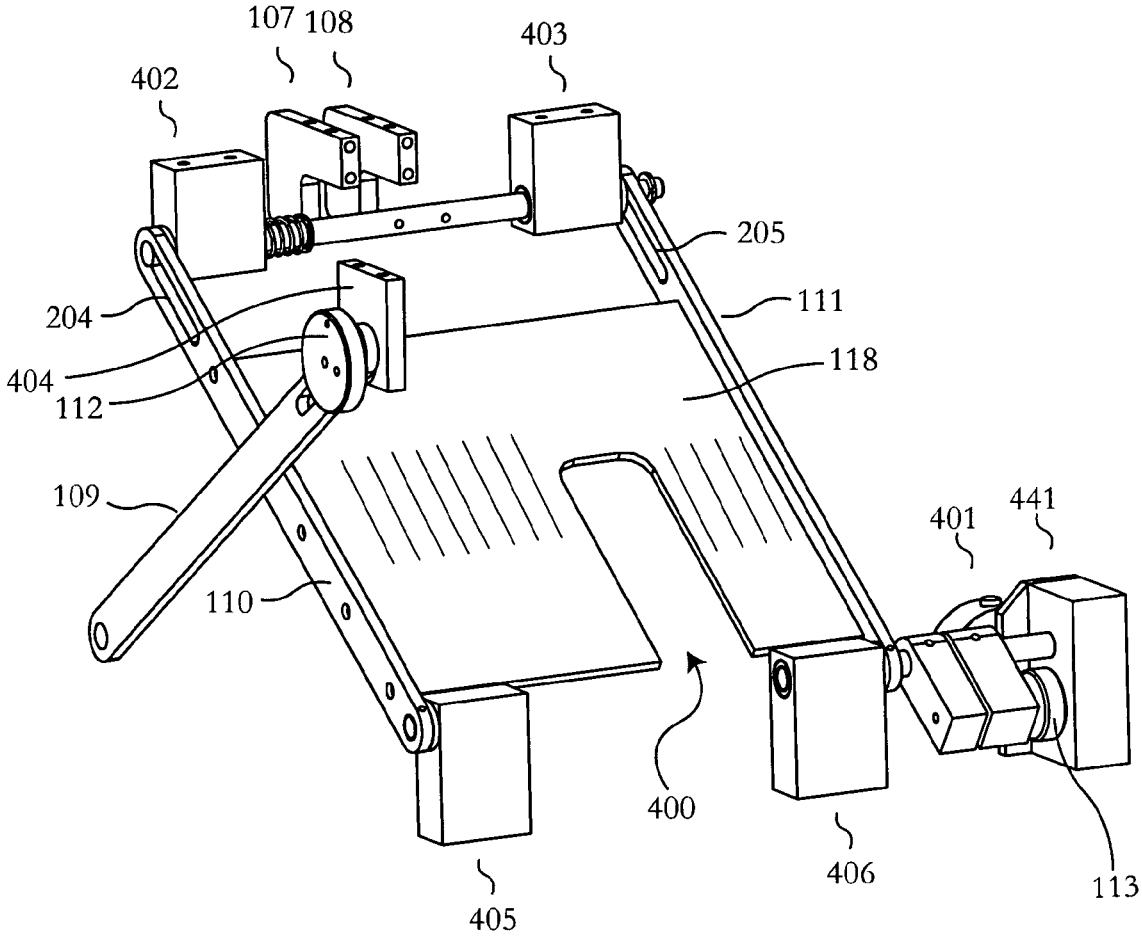
FIG. 4 shows a perspective view of an embodiment of the collapsible antenna positioner.

FIG. 4 shows a close up of collapsible antenna positioner 103 as is partially shown in FIGS. 1 and 2. Plate mounts 402, 403 and 404 act to couple antenna mounting plate 222 as shown in FIGS. 1 and 2 to positioner arms 110, 111 and 109 respectively. Positioner arms 109 and 110 are not directly coupled to one another. Pinch paddles 107 and 108 act to disengage positioner arms 110 and 111 from associated antenna mounting plate 222 in order to collapse the apparatus. When pinch paddles 107 and 108 are forced together, the common axle is disengaged and slides freely along collapse grooves 204 and 205. Similarly, when release knob 112 is activated, positioner arm 109 is disengaged from the axle associated with release know 112 allowing the axle to freely slide along collapse groove 203 as shown in FIG. 2. When motor release knob 113 is activated, elevation motor 401 and hence worm drive 441 are disengaged from positioner arm 111 allowing the apparatus to fully collapse.

Stiffness in collapsible antenna positioner 103 as shown in FIG. 1 is added via positioner arm plate 118. LNB cutout 400 provides space for LNB 105 when antenna mounting plate 222 collapses in to positioner support frame 101. Frame mounts 405 and 406 provide rotational mounts for positioner arms 110 and 111. Positioner arm 109 couples to another frame mount that is not shown for ease of illustration.

Figure 5:
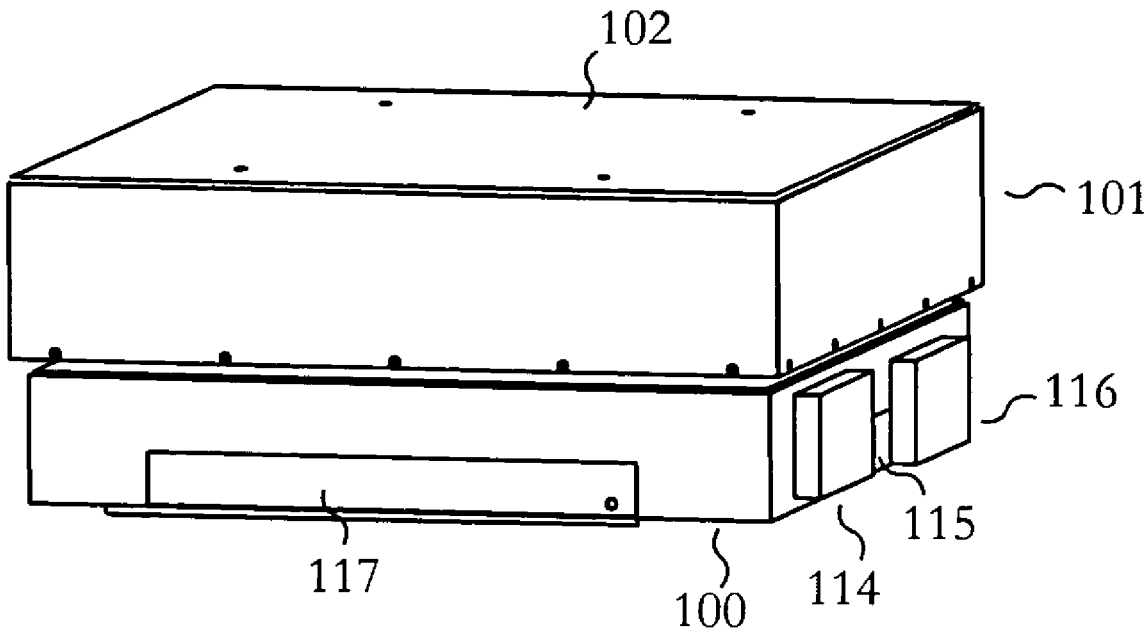
FIG. 5 shows a perspective view of an embodiment of the invention in the collapsed position.

FIG. 5 shows a perspective view of an embodiment of the invention in the collapsed position. Adjustable leg 115 is folded underneath positioner base 100. Stabilizer leg 117 is folded against the side of positioner base 100. Antenna mounting plate 222 is shown collapsed into positioner support frame 101. The apparatus as shown in FIG. 5 is ready for shipment.

Operation of embodiments of the invention comprise initial physical setup and powered acquisition of a desired satellite. Initial physical setup may comprise extending one or both of stabilizer legs 117 and 200 and in addition, optionally unfolding adjustable leg 115. As adjustable leg 115 may optionally comprise a powered stepper motor for altering the elevation of the apparatus when a satellite is near the zenith to eliminate keyholing. Alternatively, adjustable leg 115 may be manually adjusted. After any desired legs are deployed, pinch paddles 107 and 108 may be asserted in order to extend the associated axle up into the locked position on positioner arms 110 and 111. The opposing side of antenna 102 may then be lifted in order to lock the axle associated with release knob 112 in the extended position in positioner arm 109. When the axle associated with release knob 112 travels the full length of collapse groove 203, release knob 112 is in the locked position and must be asserted in order to release the associated axle and collapse the apparatus. With opposing sides of antenna 102 locked into position, motor release knob 113 is asserted in order to engage worm drive 441 and hence elevation motor 401. For connection based configurations not employing wireless communications, connecting desired communications links to a PC or other communications processor is performed. For configurations dependent upon an external computer, microcontroller 300 is optional so long as motor controller 303 comprises a communications port. As long as the external PC comprises the requisite drivers and satellite orbit calculation programs it may be substituted for microcontroller 300.

After physically deploying the apparatus, keypad port 116 may be accessed in order to operate keypad 320. Operations accessible from keypad 320 comprise acquire, stop, stow and test.

Asserting the acquire button and selecting a satellite initiates an orbital calculation that determines the location of a satellite for the time acquired via the GPS receiver. With the latitude and longitude acquired via GPS receiver 324 and the direction North and tilt of the apparatus measured via tilt sensor and magnetometer 106 all of the parameters required to point antenna 102 towards a desired satellite may be achieved. Positioner support frame 101 is rotated to the desired azimuth via drive hub 331, azimuth motor 330 and motor controller 303. Antenna 102 is elevated to the desired elevation via antenna mounting plate 222, plate mounts 402, 403 and 404, positioner arms 110, 111 and 109, worm drive 441 and elevation motor 401. Communications and control lines, not shown for ease of illustration, extend through a center hole in drive hub 331 to and from positioner base 100 and positioner support frame 101. These communications and control lines allow for the control of elevation motor 401 and receipt of down converted satellite signal via LNB 105 and measurement data from tilt sensor and magnetometer 106. For satellite locations near the zenith in the reference frame of the apparatus, an optional stepper motor at the end of adjustable leg 115 may be activated in order to shift the observed zenith of the apparatus away from the desired satellite near the observed zenith in order to prevent keyholing.

Asserting the stop button on keypad 320 stop whatever task the apparatus is currently performing. This button can be activated prior to activating the stow button. The stow button realigns positioner support frame 101 with positioner base 100 and performs a system shutdown. The test button performs internal system tests and may be activated with or without collapsible antenna positioner 103 deployed. These operations may be modified in certain embodiments or performed remotely by an attached PC or over a wireless network in other embodiments.

Figure 6:
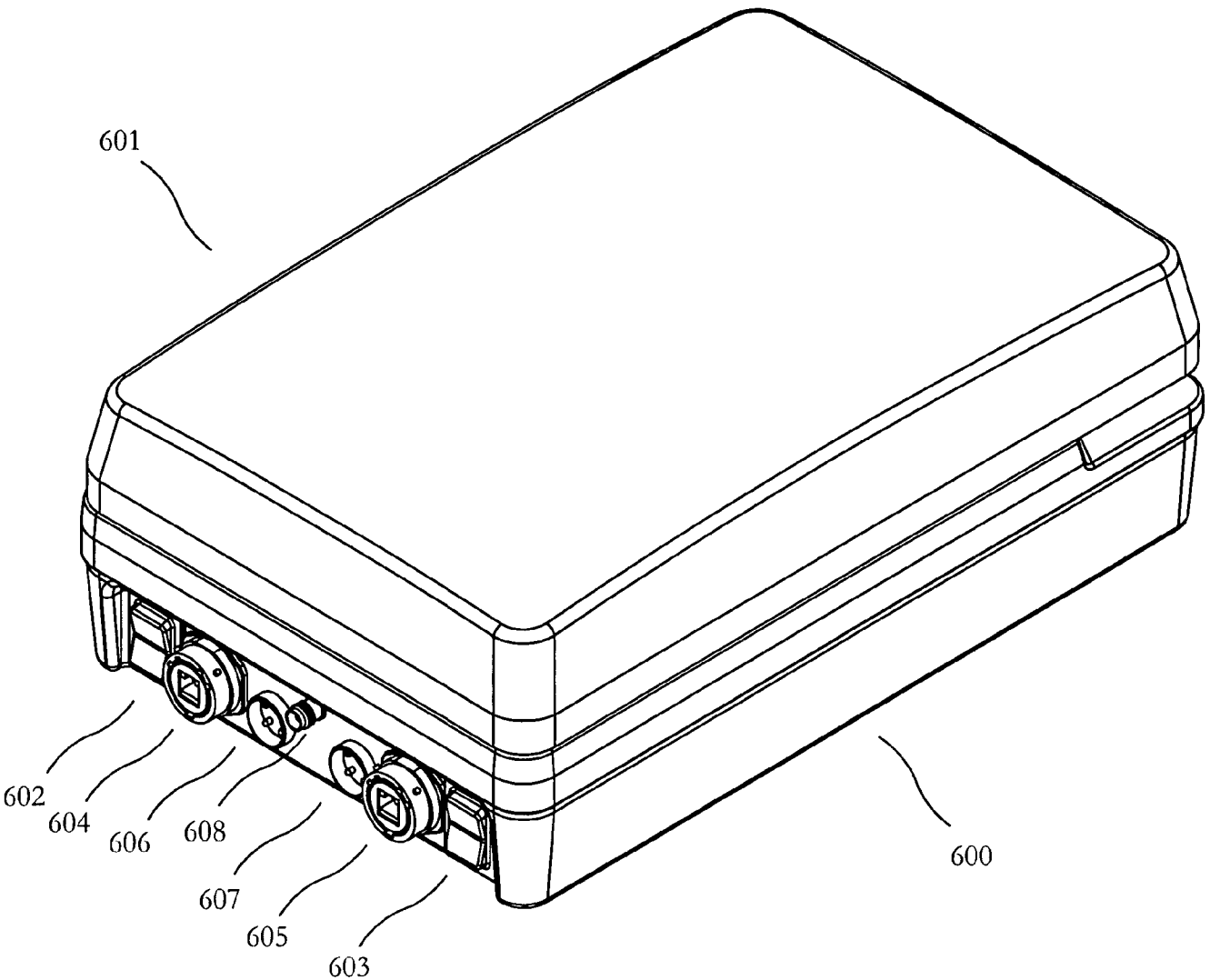
FIG. 6 shows an isometric view of an embodiment of the invention in the stowed position.

FIG. 6 shows an isometric view of an embodiment of the invention in the stowed position. Positioner base 600 houses electronic components and mates with antenna housing 601 for compact storage. Positioner base 600 provides access to power switch 602, remote computer Ethernet connector 604, power plug A 606, power plug B 607, LNB RF out 608, data Ethernet connector 605 and day/night/test switch 603. Power plug A 606 and power plug B 607 are utilized for coupling with power sources, batteries and solar panels for embodiments without built in receivers. Data Ethernet connector 605 provides internal receiver data for embodiments comprising at least one built in receiver which allows for coupling with external network devices capable of consuming a satellite data stream. In addition, one or more embodiments of the invention may use data Ethernet connector 605 for providing the apparatus with transmission data for transmission to a desired satellite. Day/night/test switch 603 is utilized in order to set the display (shown in FIGS. 8–10) to provide for day and night time visual needs while the third position is utilized in order to test the system without deploying antenna housing 601.

Figure 7:
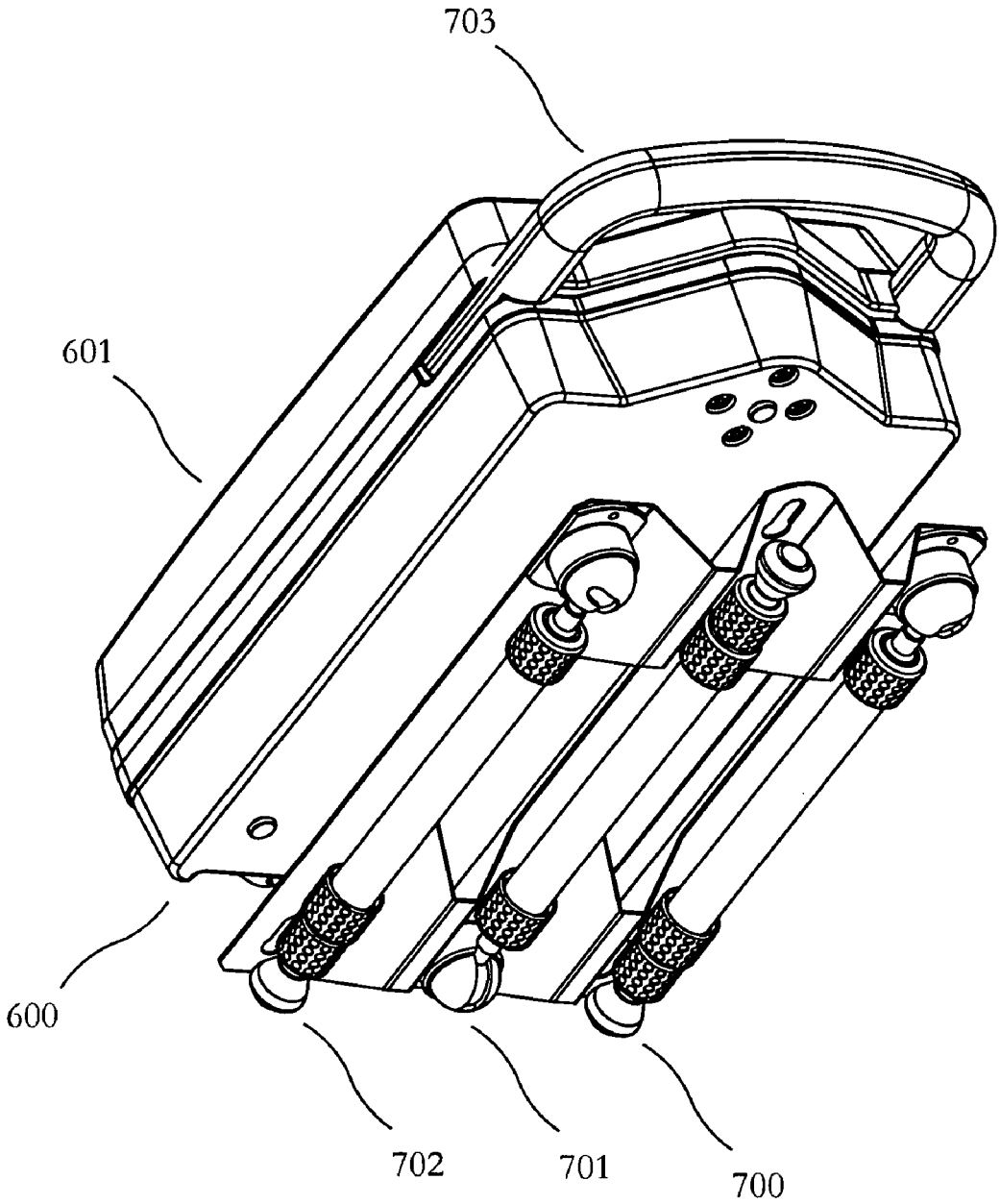
FIG. 7 shows an isometric view of the bottom of an embodiment of the invention in the stowed position.

FIG. 7 shows an isometric view of the bottom of an embodiment of the invention in the stowed position. Carrying handle 703 may be used to physically move the apparatus. Legs 700, 701 and 702 may form a removable leg system as shown or may independently be mounted to the bottom of positioner base 600. In addition, a stackable module may be coupled to positioner base 600 in order to provide cryptographic, power/battery, router or any other functionality to augment the capabilities of the apparatus.

Figure 8:
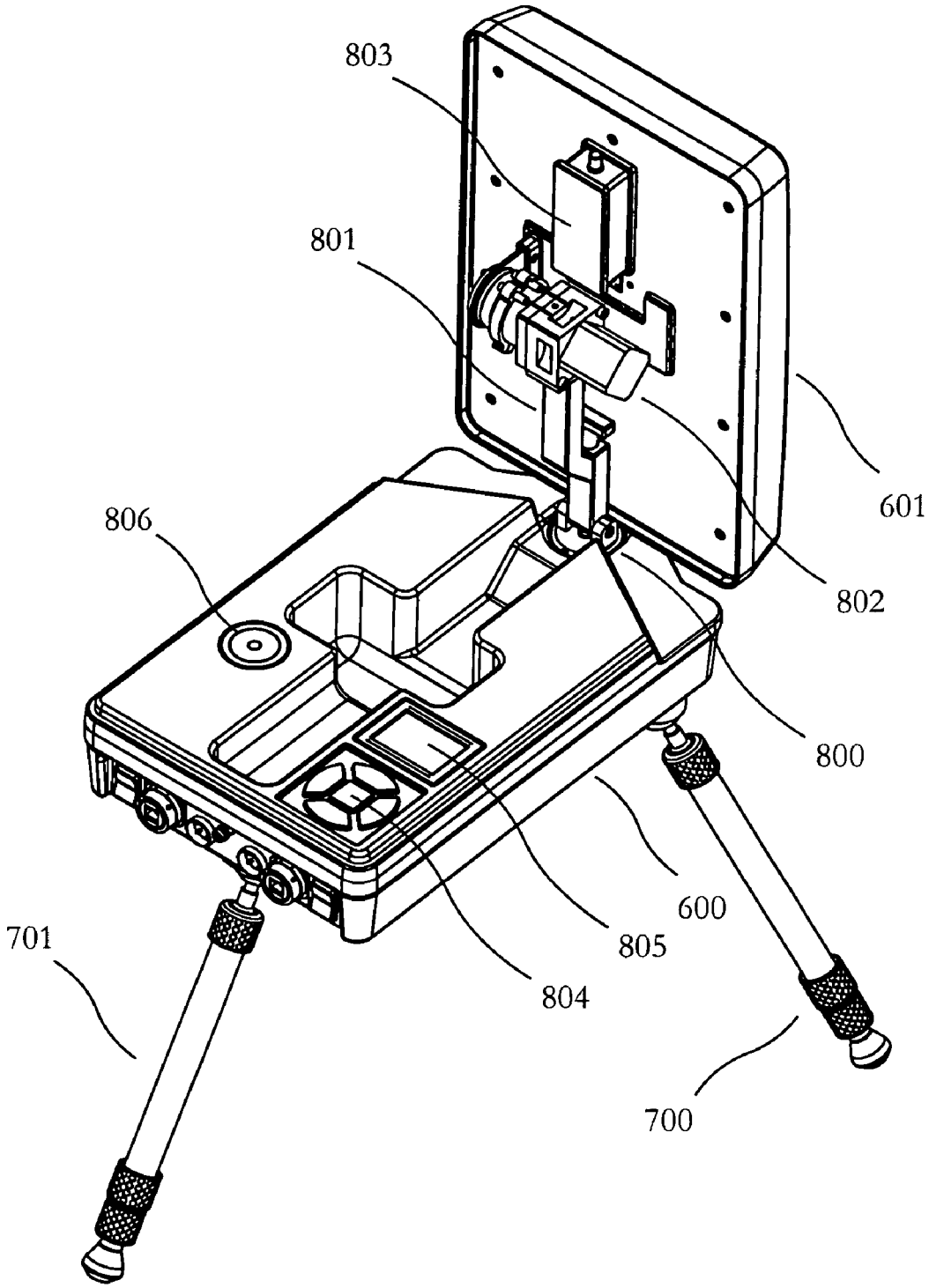
FIG. 8 shows an isometric view of an embodiment of the invention in the deployed position.

FIG. 8 shows an isometric view of an embodiment of the invention in the deployed position. Legs 700 and 701 are shown in the deployed position. Bubble level 806 is used to level positioner base 600 in combination with the legs or by placing objects underneath an embodiment of the invention not comprising legs until positioner base 600 is roughly level. Keypad 804 and display 805 are utilized in order to control the apparatus. Also shown is azimuth motor 800 that rotates positioning arm 801 and elevation motor 802 which rotates antenna housing 601 in elevation. LNB 803 couples with the reverse side of the antenna that is located within antenna housing 601. When opening one embodiment of the invention, positioning arm 801 locks into a vertical position as shown and after selecting a satellite to acquire an internal or external microcontroller rotates azimuth motor 800 and elevation motor 802 based on the GPS position, time and compass orientation of the apparatus. One embodiment of the invention may provide a limited turning range for azimuth motor 800 for example 30 degrees, in order to limit the overall weight of the device by allowing for simpler cable routing and minimizing complexity of the mechanism. Positioner base 600 comprises an indentation shown in the middle of positioner base 600 for housing positioning arm 801, elevation motor 802 and LNB 803 when in the stowed position. Electronic components internal to positioner base 600 may comprise a microcontroller which hosts a control program which reads inputs from keypad 804 and commands azimuth motor 800 to rotate to a desired azimuth. Positioner base 600 may also comprise a GPS receiver that provides time and position information to the microcontroller. Positioner base 600 and antenna housing 601 may comprise a three axis accelerometer or inclinometer, magnetometer, data receiver and relative signal strength indicator (RSSI) receiver and reports to the microcomputer the signal strength of the signal received and that information is used for the accurate pointing of the antenna.

Figure 9:
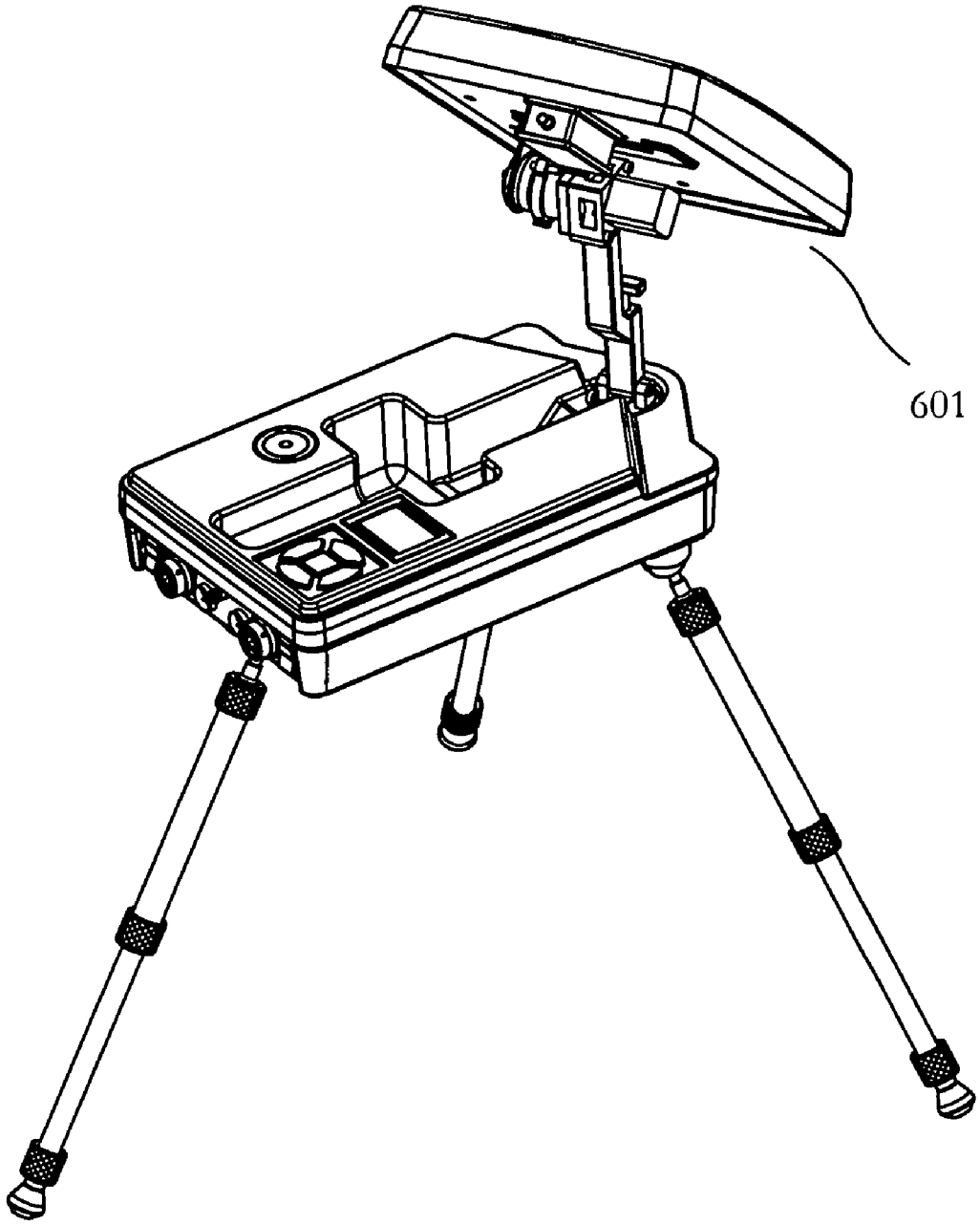
FIG. 9 shows an isometric view of an embodiment of the invention with the antenna housing at a first azimuth and elevation setting.
Figure 10:
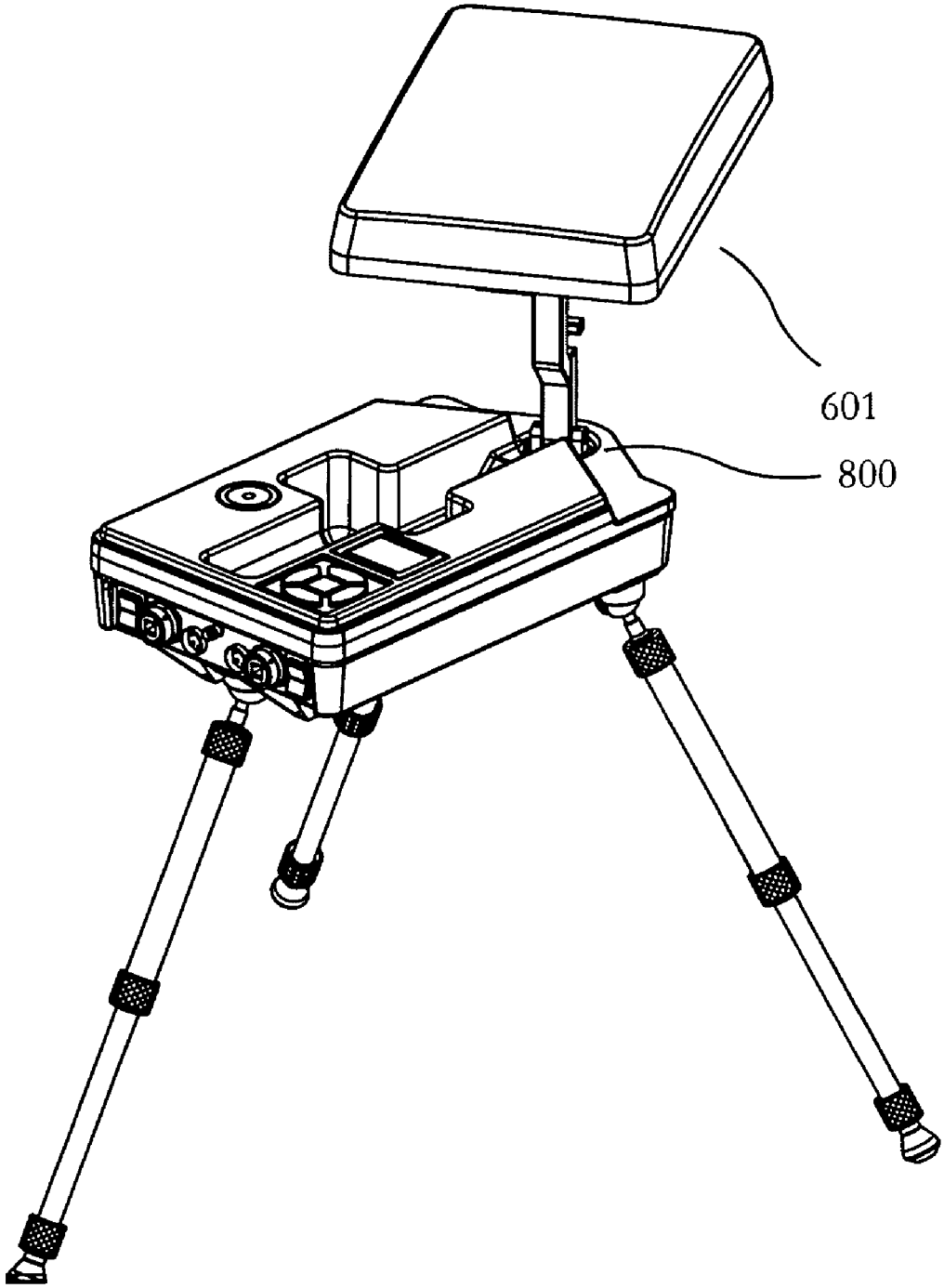
FIG. 10 shows an isometric view of an embodiment of the invention with the antenna housing at a second azimuth and elevation setting.

FIG. 9 shows an isometric view of an embodiment of the invention with the antenna housing at a first azimuth and elevation setting. Antenna housing 601 in this figure is pointed at a satellite midway between the zenith and horizon. FIG. 10 shows an isometric view of an embodiment of the invention with the antenna housing at a second azimuth and elevation setting wherein the satellite is directly above the apparatus at the zenith. One or more embodiments of the control program may search for a desired satellite by scanning along the azimuth as the elevation of the apparatus is generally fairly accurate and wherein the local magnetometer may give readings that are subject to magnetic sources that influence the magnetic field local to the apparatus.

After physically deploying the apparatus, keypad 804 as shown in FIG. 8 may be utilized in order to operate the apparatus. Operations accessible from keypad 804 comprise acquire, stop, stow and test and may also include functions for receiving meta data regarding a channel for example a program information such as an electronic program guide for a channel or multiple channels. Data received by the apparatus may comprise weather data, data files, real-time video feeds or any other type of data. Data may be received on command or programmed for receipt at a later time based on the program information metadata. Keypad 804 may also comprise buttons or functions that are accessed via buttons or other elements for recording a particular channel, for controlling a transmission, for updating ephemeris data for password entry, for searching utilizing an azimuth scan or for searching for any satellite within an area to better locate a desired satellite. Any other control function that may be activated via keypad 804 may be executed by an onboard or external computer in order to control or receive or send data via the apparatus.

Asserting the acquire button and selecting a satellite initiates an orbital calculation that determines the location of a satellite for the time acquired via the GPS receiver. With the latitude and longitude acquired via GPS receiver and the direction North and tilt of the apparatus measured via tilt sensor and magnetometer all of the parameters required to point the antenna towards a desired satellite are achieved. Antenna housing 601 is rotated to the desired azimuth via azimuth motor 800. The antenna in antenna housing 601 is elevated to the desired elevation via elevation motor 802. The internal RSSI receiver may also be used in order to optimize the direction that the antenna is pointing to maximize the signal strength.

Asserting the stop button on keypad 804 stops whatever task the apparatus is currently performing. This button can be activated prior to activating the stow button. The stow button realigns positioner arm 801 with positioner base 600 and performs a system shutdown. The test button performs internal system tests and may be activated with or without antenna housing 601 deployed. These operations may be modified in certain embodiments or performed remotely by an attached PC or over a wireless network in other embodiments.

Figure 11:
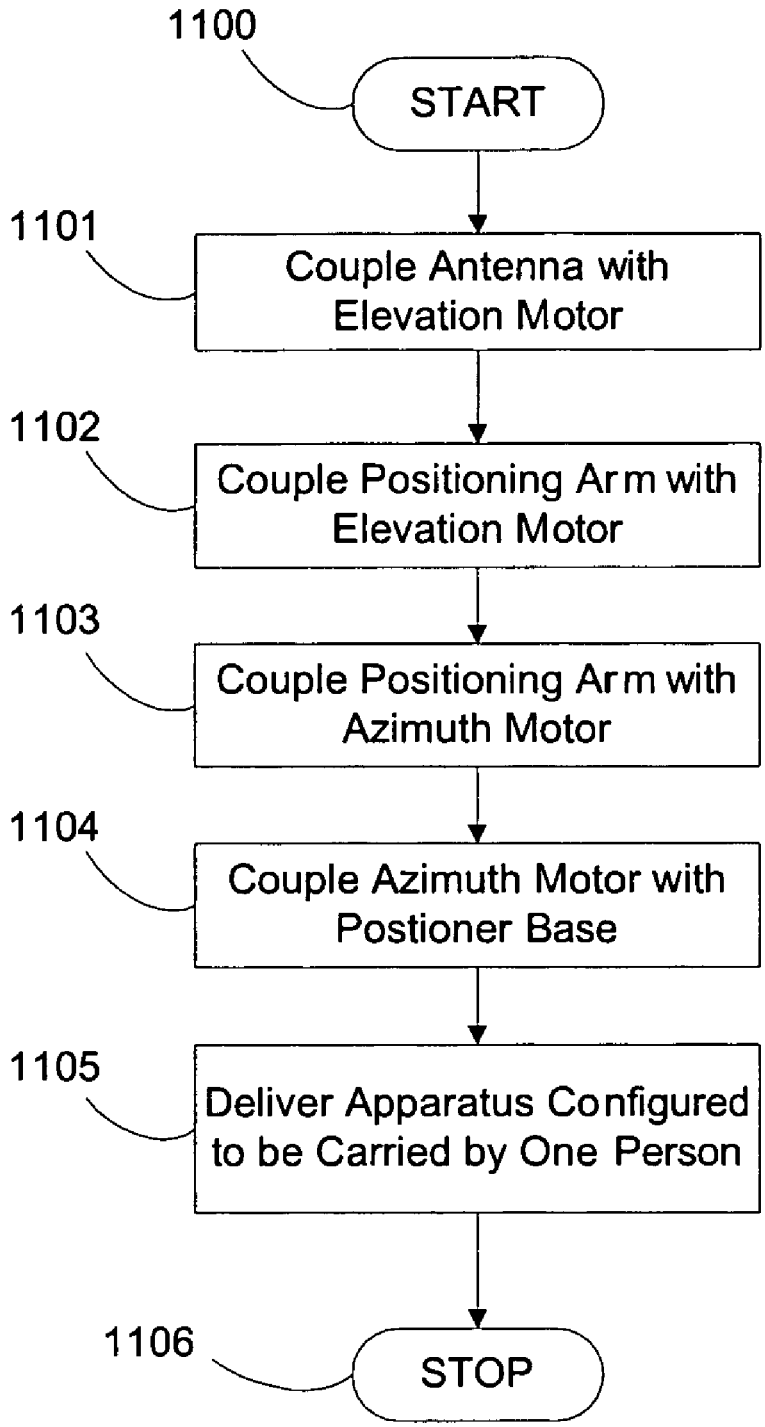
FIG. 11 shows a flowchart depicting the manufacture of one or more embodiments of the invention.

FIG. 11 shows a flowchart depicting the manufacture of one or more embodiments of the invention which starts at 1100 and comprises coupling an antenna with an elevation motor at 1101. Optionally a cover or antenna housing may be coupled with the antenna (not shown in FIG. 11 for ease of illustration). At least one positioning arm is then coupled with the elevation motor at 1102. The positioning arm is further coupled with an azimuth motor at 1103. The azimuth motor is then coupled with a positioner base at 1104. The positioner base may optionally comprise a configuration that limits the amount of azimuth travel in order to allow for a smaller or more compact azimuth motor and to cut total weight from the system. The apparatus is delivered to an individual in a configuration that allows for a single person to carry the apparatus at 1105 wherein the manufacture is complete at 1106.

Thus embodiments of the invention directed to a Collapsible Antenna Positioner Apparatus and Method have been exemplified to one of ordinary skill in the art. The claims, however, and the full scope of any equivalents are what define the metes and bounds of the invention.

What is claimed is:

1. A portable antenna positioner comprising:

an antenna;

an elevation motor coupled with said antenna wherein said antenna is configured to rotate up to 180 degrees in elevation wherein one side of said antenna may be oriented vertically in a first position when said antenna is rotated in a first direction with said elevation motor and wherein an opposing side of said antenna may be oriented above horizontal in a second position when said antenna is rotated in an opposing direction to said first direction with said elevation motor and wherein said antenna receives satellite signals in said first position and said second position;

at least one positioning arm coupled with said elevation motor;

an azimuth motor coupled with said at least one positioning arm;

a positioner base coupled with said azimuth motor; and, said antenna, said elevation motor, said at least one positioning arm, said azimuth motor and said positioning base configured to be stowed and deployed and carried by a single person.

2. The portable antenna positioner of claim 1 further comprising:

a computing element configured to align said antenna to point at a satellite when said single person activates an acquire button coupled with said computing element.

3. The portable antenna positioner of claim 2 further comprising:

at least one GPS receiver;

at least one magnetometer;

at least one inclinometer; and, said computing element configured to utilize time and position information from said at least one GPS receiver, orientation information from said at least one magnetometer and declination information from said at least one inclinometer in order to align said antenna with said satellite.

4. The portable antenna positioner of claim 1 further comprising:

a storage device configured to store a satellite transmission.

5. The portable antenna positioner of claim 1 further comprising:

a storage device configured to store metadata regarding a satellite transmission.

6. The portable antenna positioner of claim 1 further comprising:

a storage device configured to store ephemeris data.

7. The portable antenna positioner of claim 1 further comprising:

a computing element;

a cryptographic module coupled with said computing element.

8. The portable antenna positioner of claim 1 further comprising:

a computing element;

a router module coupled with said computing element.

9. The portable antenna positioner of claim 1 further comprising:

at least one leg coupled with said positioner base.

10. A method for utilizing a portable antenna positioner comprising:

coupling an antenna with an elevation motor wherein said antenna is configured to rotate up to 180 degrees in elevation wherein one side of said antenna may be oriented vertically in a first position when said antenna is rotated in a first direction with said elevation motor and wherein an opposing side of said antenna may be oriented above horizontal in a second position when said antenna is rotated in an opposing direction to said first direction with said elevation motor and wherein said antenna receives satellite signals in said first position and said second position;

coupling at least one positioning ann with said an elevation motor;

coupling said at least one positioning arm with an azimuth motor; and, coupling said azimuth motor with a positioner base wherein said antenna, said elevation motor, said at least one positioning arm, said azimuth motor and said positioning base are configured to be stowed, deployed and carried by a single person.

11. The method of claim 10 further comprising:

stowing said antenna in a stowed position proximate to said positioner base wherein said positioner arm is retracted proximate to said positioner base.

12. The method of claim 10 further comprising:

deploying said antenna in a deployed position wherein said positioner arm is extended upward from said positioner base.

13. The method of claim 10 further comprising:

locating a satellite using timing and position data from at least one GPS receiver, orientation data from at least one magnetometer, declination data from at least one inclinometer and ephemeris data when said single person activates an acquire button coupled with a computing element configured to move said azimuth motor and said elevation motor.

14. The method of claim 10 further comprising:

locating a satellite using an RSSI receiver.

15. The method of claim 10 further comprising:

receiving data from said antenna.

16. The method of claim 10 further comprising:

receiving metadata from said antenna.

17. The method of claim 16 wherein said metadata comprises program information for at least one satellite channel.

18. The method of claim 10 further comprising:

receiving ephemeris data from a satellite.

19. The method of claim 10 further comprising:

transmitting data via said antenna.

20. The method of claim 10 further comprising:

coupling with a module selected from the group consisting of cryptographic module, router module and power module.

21. A portable antenna positioner comprising:

an antenna;

an elevation motor coupled with said antenna wherein said antenna is configured to rotate up to 180 degrees in elevation wherein one side of said antenna may be oriented vertically in a first position when said antenna is rotated in a first direction with said elevation motor and wherein an opposing side of said antenna may be oriented above horizontal in a second position when said antenna is rotated in an opposing direction to said first direction with said elevation motor and wherein said antenna receives satellite signals in said first position and said second position;

at least one positioning arm coupled with said elevation motor;

an azimuth motor coupled with said at least one positioning arm;

a positioner base coupled with said azimuth motor;

said antenna, said elevation motor, said at least one positioning arm, said azimuth motor and said positioning base configured to be stowed and deployed and carried by a single person;

a computing element configured to align said antenna to point at a satellite;

at least one receiver;

at least one magnetometer;

at least one inclinometer; and, said computing element configured to utilize time and position information from said at least one GPS receiver, orientation information from said at least one magnetometer and decimation information from said at least one inclinometer in order to align said antenna with said satellite.

22. The portable antenna positioner of claim 21 wherein said receiver comprises a GPS receiver.

23. The portable antenna positioner of claim 21 wherein said receiver comprises a data receiver.

24. The portable antenna positioner of claim 21 wherein said receiver comprises a RSSI receiver.

* * * * *